US009638408B2

(12) United States Patent
Park et al.

(10) Patent No.: US 9,638,408 B2
(45) Date of Patent: May 2, 2017

(54) LIGHTING DEVICE

(71) Applicant: LG INNOTEK CO., LTD., Seoul (KR)

(72) Inventors: Jong Chan Park, Seoul (KR); Kyung Il Kong, Seoul (KR); Byeong Guk Min, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 100 days.

(21) Appl. No.: 14/691,989

(22) Filed: Apr. 21, 2015

(65) Prior Publication Data

US 2015/0226388 A1 Aug. 13, 2015

Related U.S. Application Data

(63) Continuation of application No. 13/609,564, filed on Sep. 11, 2012, now Pat. No. 9,039,217.

(30) Foreign Application Priority Data

Sep. 21, 2011 (KR) ..... 10-2011-0095128
Sep. 21, 2011 (KR) ..... 10-2011-0095129
(Continued)

(51) Int. Cl.
*F21V 29/70* (2015.01)
*F21S 10/00* (2006.01)
(Continued)

(52) U.S. Cl.
CPC ..... *F21V 29/70* (2015.01); *F21K 9/23* (2016.08); *F21K 9/64* (2016.08); *F21S 10/007* (2013.01);
(Continued)

(58) Field of Classification Search
CPC ... F21K 9/23; F21K 9/64; F21V 13/10; F21V 13/14; F21V 13/08; F21V 14/06;
(Continued)

(56) References Cited

U.S. PATENT DOCUMENTS 7,984,999 B2 7/2011 Harbers et al.
8,783,887 B2 7/2014 Caruso et al.
(Continued)

FOREIGN PATENT DOCUMENTS

CN 101828072 A * 9/2010 ..... F21S 10/02
CN 101842907 A * 9/2010 ..... F21V 9/10
(Continued)

OTHER PUBLICATIONS

Chinese Office Action issued in Application No. 201280046062.5 dated Jul. 3, 2015.
(Continued)

*Primary Examiner* — David V Bruce
(74) *Attorney, Agent, or Firm* — Ked & Associates, LLP

(57) ABSTRACT

A lighting device may be provided that includes: a light emitting device; and an optical exciter which is disposed over the light emitting device and emits light excited by the light emitted from the light emitting device, wherein the optical exciter includes at least one of a yellow fluorescent material, a green fluorescent material and a red fluorescent material, wherein the optical exciter moves over the light emitting device, and wherein a color temperature of the light emitted from the optical exciter varies according to the movement of the optical exciter.

18 Claims, 12 Drawing Sheets

(30) Foreign Application Priority Data

Sep. 29, 2011 (KR) ..... 10-2011-0098660
Oct. 4, 2011 (KR) ..... 10-2011-0100745

(51) Int. Cl.

| | |
|---|---|
| ***F21V 9/16*** | (2006.01) |
| ***F21V 9/10*** | (2006.01) |
| ***F21V 7/00*** | (2006.01) |
| ***F21V 13/08*** | (2006.01) |
| ***F21V 13/10*** | (2006.01) |
| ***F21V 13/14*** | (2006.01) |
| ***F21V 14/06*** | (2006.01) |
| ***F21V 14/08*** | (2006.01) |
| ***F21K 9/23*** | (2016.01) |
| ***F21K 9/64*** | (2016.01) |
| *F21V 7/22* | (2006.01) |
| *F21V 13/02* | (2006.01) |
| *F21V 29/77* | (2015.01) |
| *F21V 29/75* | (2015.01) |
| *F21V 29/85* | (2015.01) |
| *F21V 3/04* | (2006.01) |
| *F21Y 101/00* | (2016.01) |
| *F21K 9/62* | (2016.01) |

(52) U.S. Cl.

CPC ..... *F21V 7/0066* (2013.01); *F21V 9/10* (2013.01); *F21V 9/16* (2013.01); *F21V 13/08* (2013.01); *F21V 13/10* (2013.01); *F21V 13/14* (2013.01); *F21V 14/06* (2013.01); *F21V 14/08* (2013.01); *F21K 9/62* (2016.08); *F21V 3/0445* (2013.01); *F21V 7/22* (2013.01); *F21V 13/02* (2013.01); *F21V 29/75* (2015.01); *F21V 29/77* (2015.01); *F21V 29/773* (2015.01); *F21V 29/85* (2015.01); *F21Y 2101/00* (2013.01)

(58) Field of Classification Search

CPC ... F21V 14/08; F21V 9/10; F21V 9/16; F21V 7/0066; F21V 29/70; F21S 10/007

See application file for complete search history.

(56) References Cited

U.S. PATENT DOCUMENTS

| | | | | |
|---|---|---|---|---|
| 2007/0019408 | A1 | 1/2007 | McGuire, Jr. et al. | |
| 2009/0086475 | A1 | 4/2009 | Caruso et al. | |
| 2009/0103293 | A1 | 4/2009 | Harbers et al. | |
| 2009/0284148 | A1 | 11/2009 | Iwanaga | |
| 2010/0033948 | A1 | 2/2010 | Harbers et al. | |
| 2010/0128462 | A1 | 5/2010 | Chern et al. | |
| 2013/0176707 | A1* | 7/2013 | Audette ..... | F21V 29/20 362/84 |

FOREIGN PATENT DOCUMENTS

| | | | |
|---|---|---|---|
| KR | 10-0728134 | B1 | 6/2007 |
| KR | 10-2010-0030805 | A | 3/2010 |
| KR | 10-2010-0129030 | A | 12/2010 |
| KR | 10-2011-0050911 | A | 5/2011 |
| KR | 10-2011-0051872 | A | 5/2011 |
| KR | 10-2011-0101515 | A | 9/2011 |
| TW | 201126092 | A | 8/2011 |

OTHER PUBLICATIONS

European Search Report issued in application No. 12833243.4 dated Jan. 13, 2015.

International Search Report issued in Application No. PCT/KR2012/007303 dated Feb. 28, 2013.

U.S. Office Action issued in co-pending U.S. Appl. No. 13/609,564 dated Sep. 22, 2014.

U.S. Notice of Allowance issued in co-pending U.S. Appl. No. 13/609,564 dated Jan. 21, 2015.

* cited by examiner

LIGHTING DEVICE

CROSS-REFERENCE TO RELATED APPLICATION

The present application is a continuation of application Ser. No. 13/609,564 which claims priority under 35 U.S.C. §119(e) of Korean Patent Application Nos. 10-2011-0095128 and 10-2011-0095129 filed Sep. 21, 2011, No. 10-2011-0098660 filed Sep. 29, 2011 and No. 10-2011-0100745 filed Oct. 4, 2011 the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The LED generates much heat when turned on. If the heat is not readily radiated, the life span and illuminance of the LED are reduced and quality characteristic is remarkably deteriorated.

A white light emitting device package is now being increasingly used as a lighting device's light source. Recently, a concept of so-called emotional lighting has come. Thus, a cool white light source having a high color temperature and a warm white light source having a low color temperature are selected and used according to user's preference and use.

SUMMARY

One embodiment is a lighting device. The lighting device includes: a light emitting device; and an optical exciter which is disposed over the light emitting device and emits light excited by the light emitted from the light emitting device, wherein the optical exciter includes at least one of a yellow fluorescent material, a green fluorescent material and a red fluorescent material, wherein the optical exciter moves over the light emitting device, and wherein a color temperature of the light emitted from the optical exciter varies according to the movement of the optical exciter.

Another embodiment is a lighting device. The lighting device includes: a body part including one side; a light source module which is disposed on the one side of the body part and is disposed on a first axis; a cover which is disposed over the light source module, includes at least two holes and rotates about a second axis parallel with the first axis; and optical excitation plates which are disposed in the holes respectively and move over the light source module, wherein color temperatures of lights emitted from the optical excitation plates are different from each other by the movements of the optical excitation plates.

Further another embodiment is a lighting device. The lighting device includes: a body part; a light emitting device disposed in the body part; and a diffusion plate disposed over the light emitting device, wherein the body part includes a reflective layer which is disposed within the body part and surrounds the light emitting device, and a fluorescent layer which is disposed between the reflective layer and the body part, wherein the fluorescent layer includes a fluorescent surface including at least one fluorescent material, wherein the reflective layer includes a punched hole corresponding to the fluorescent surface, and wherein at least one of the fluorescent surface and the reflective layer rotates, and a color temperature of light emitted from the diffusion plate varies by the movements of at least one of the fluorescent surface and the reflective layer.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
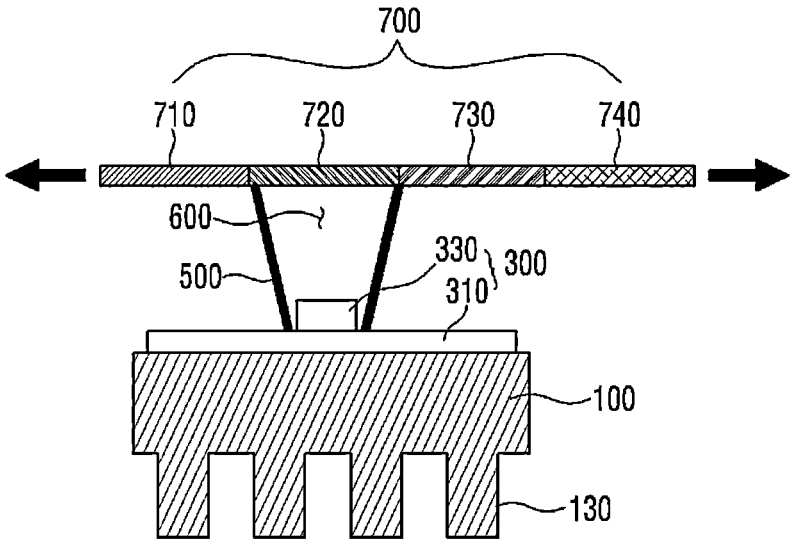
FIG. 1 is a cross sectional view of a lighting device according to an embodiment.

FIG. 1 is a cross sectional view of a lighting device according to an embodiment.

Referring to FIG. 1, the lighting device according to the embodiment may include a body part 100, a light source module 300, a reflector 500 and an optical exciter 700. Hereafter, the following detailed description will focus on each component of the lighting device according to the embodiment.

The body part 100 has a predetermined volume. The body part 100 may form a main appearance of the lighting device according to the embodiment.

The light source module 300 may be formed on one side of the body part 100. The body part 100 may be a heat sink which receives heat from the light source module 300 and radiates the heat.

The body part 100 may include at least one heat radiating fin 130. A plurality of the heat radiating fins 130 may have a shape projecting outwardly from the outer surface of the body part 100. The heat radiating fin 130 increases the surface area of the body part 100 and improves heat radiation efficiency. Since the increase of the number of the heat radiating fins increases a contact area of the body part 100 and the air, the heat radiation efficiency is improved. However, manufacturing cost rises and structural weakness may be caused. Also, since the amount of generated heat is changed according to the power capacity of the lighting device, it is required to determine the appropriate number of the heat radiating fins 130 in accordance with the power capacity.

The body part 100 may be formed of a metallic material or a resin material which has excellent heat radiation efficiency. However, there is no limit to the material of the body part 100. For example, the body part 100 may be formed of Fe, Al, Ni, Cu, Ag, Sn, Mg and the like or an alloy including at least two materials among them. Carbon steel and stainless steel can be also used as the material of the body part 100. Anti-corrosion coating or insulating coating may be performed on the surface of the body part 100 within a range which does not affect thermal conductivity.

Though not shown in the drawing, a heat radiating plate (not shown) may be disposed between the body 100 and the light source module 300. The heat radiating plate (not shown) may be a thermal conduction silicon pad or a thermal conductive tape which has high thermal conductivity. The heat radiating plate (not shown) is able to effectively transfer the heat generated from the light source module 300 to the body part 100.

The light source module 300 is disposed on the body part 100. Specifically, the light source module 300 may be disposed on one side of the body part 100.

The light source module 300 may include a substrate 310 and a light emitting device 330.

The substrate 310 may be any one of a common PCB, a metal core PCB (MCPCB), a standard FR-4 PCB or a flexible PCB.

The substrate 310 may directly contact with the body part 100. Specifically, the substrate 310 may contact with one side of the body part 100.

The light emitting device 330 is disposed on the substrate 310.

A light reflective material may be coated or deposited on the substrate 310 in order to easily reflect light emitted from the light emitting device 330.

For structural purpose and/or in order to improve the heat transfer to the body part 100, the substrate 310 may selectively include a thermal tape or a thermal pad.

One or a plurality of the light emitting devices 330 may be disposed on the substrate 310. The plurality of the light emitting devices 330 may emit lights having the same wavelength or lights having mutually different wavelengths. Also, the plurality of the light emitting devices 330 may emit lights having the same color.

The light emitting devices 330 may be one of a blue light emitting device emitting blue light, a green light emitting device emitting green light, a red light emitting device emitting red light and a white light emitting device emitting white light.

When the light emitting device 330 is the blue light emitting device, the light source module 300 may further include a molding part (not shown) disposed on the blue light emitting device 330. The molding part (not shown) may be disposed on the substrate 310 in such a manner as to cover the blue light emitting device. The molding part (not shown) may include a fluorescent material. Here, the fluorescent material included in the molding part (not shown) may be one of a yellow fluorescent material, a green fluorescent material and a red fluorescent material.

The light emitting device 330 may be a light emitting diode (LED) chip. The LED chip may be any one of a blue LED chip emitting blue light in a visible light spectrum, a green LED chip emitting green light, and a red LED chip emitting red light. Here, the blue LED chip has a dominant wavelength of from about 430 nm to 480 nm. The green LED chip has a dominant wavelength of from about 510 nm to 535 nm. The red LED chip has a dominant wavelength of from about 600 nm to 630 nm.

The reflector 500 reflects the light emitted from the light source module 300.

The reflector 500 surrounds the light source module 300 and reflects the light emitted from the light source module 300 to the optical exciter 700.

The reflector 500 is able to collect the light emitted from the light source module 300 to only a particular portion of the optical exciter 700. For example, as shown in FIG. 1, the upper portion of the reflector 500 includes a second plate 720 of the optical exciter 700, so that the reflector 500 is able to collect the light emitted from the light source module 300 to a particular portion of the second plate 720 of the optical exciter 700.

The reflector 500 may be a reflective surface which reflects the light emitted from the light source module 300. The reflective surface may be substantially perpendicular to the substrate 310 or may form an obtuse angle with the top surface of the substrate 310. The reflective surface may be coated or deposited with a material capable of easily reflecting the light.

The optical exciter 700 may generate light excited by the light emitted from the light emitting device 330 of the light source module 300. It is possible to create white light having various color temperatures by mixing the excited light generated by the optical exciter 700 with the light emitted from the light emitting device 330.

The optical exciter 700 may be an optical excitation plate having a predetermined thickness.

The optical excitation plate 700 is disposed on the reflector 500 and is spaced apart at a predetermined interval from the light source module 300. In order than the optical excitation plate 700 is spaced apart at a predetermined interval from the light source module 300, the optical excitation plate 700 may be disposed on the upper portion of the reflector 500.

A mixing space 600 may be formed by the optical excitation plate 700, the reflector 500 and the body part 100. The lights which are emitted from the light source module 300 or the lights which are emitted from the light source module 300 and reflected by the reflector 500 are mixed in the mixing space 600.

The optical excitation plate 700 may include at least one of a yellow fluorescent material, a green fluorescent material and a red fluorescent material. The yellow fluorescent material emits light having a dominant wavelength of from 540 nm to 585 nm in response to the blue light (430 nm to 480 nm). The green fluorescent material emits light having a dominant wavelength of from 510 nm to 535 nm in response to the blue light (430 nm to 480 nm). The red fluorescent material emits light having a dominant wavelength of from 600 nm to 650 nm in response to the blue light (430 nm to 480 nm). The yellow fluorescent material may be a silicate fluorescent material or a YAG fluorescent material. The green fluorescent material may be a silicate fluorescent material, nitride fluorescent material or a sulfide fluorescent material. The red fluorescent material may be a nitride fluorescent material or a sulfide fluorescent material.

The optical excitation plate 700 may move over the light emitting device 330 of the light source module 300 instead of being fixed over the light emitting device 330. As the optical excitation plate 700 moves, the light emitted from the light emitting device 330 may be irradiated on any one of several plates 710, 720, 730 and 740 of the optical excitation plate 700.

The optical excitation plate 700 may include mutually different plates 710, 720, 730 and 740. For example, the optical excitation plate 700 may include a first to a fourth plates 710, 720, 730 and 740.

The kinds and amounts of the fluorescent materials included in the plural plates 710, 720, 730 and 740 may be changed according to the light emitting device 330 of the light source module 300. This will be described with reference to a detailed example.

When the light emitting device 330 of the light source module 300 is a blue light emitting device, the first to the fourth plates 710, 720, 730 and 740 include yellow, green and red fluorescent materials. The content ratios of the yellow, green and red fluorescent materials included in the first to the fourth plates 710, 720, 730 and 740 may be different from each other. Since the content ratio of the yellow, green and red fluorescent materials included in the first plate 710, the content ratio of the yellow, green and red fluorescent materials included in the second plate 720, the content ratio of the yellow, green and red fluorescent materials included in the third plate 730, and the content ratio of the yellow, green and red fluorescent materials included in the fourth plate 740 are different from each other, the color temperatures of the lights emitted from the first to the fourth plates 710, 720, 730 and 740 may be different from each other.

Additionally, when the light emitting device 330 of the light source module 300 is the blue light emitting device, the first plate 710 may include the yellow fluorescent material, the second plate 720 may include the yellow fluorescent material and the green fluorescent material, the third plate 730 may include the yellow fluorescent material and the red fluorescent material, and the fourth plate 740 may include the yellow fluorescent material, the green fluorescent material and the red fluorescent material. Therefore, the color temperatures of the lights emitted from the first to the fourth plates 710, 720, 730 and 740 may be different from each other.

When the light source module 300 includes the blue light emitting device 330 and a molding part (not shown) which covers the blue light emitting device 330 and includes the yellow fluorescent material, the first plate 710 may include the green fluorescent material, the second plate 720 may include the red fluorescent material, the third plate 730 may include the green fluorescent material and the red fluorescent material. The fourth plate 740 may include the green fluorescent material and the red fluorescent material, and may have a different content ratio of the green fluorescent material and the red fluorescent material from that of the third plate 730. The fourth plate 740 may also include the green fluorescent material like the first plate 710.

When the light source module 300 includes the blue light emitting device 330 and a molding part (not shown) which covers the blue light emitting device 330 and includes the green fluorescent material, the first plate 710 may include the yellow fluorescent material, the second plate 720 may include the red fluorescent material, the third plate 730 may include the yellow fluorescent material and the red fluorescent material. The fourth plate 740 may include the yellow fluorescent material and the red fluorescent material, and may have a different content ratio of the yellow fluorescent material and the red fluorescent material from that of the third plate 730. The fourth plate 740 may also include the yellow fluorescent material like the first plate 710.

When the light source module 300 includes the blue light emitting device 330 and a molding part (not shown) which covers the blue light emitting device 330 and includes the red fluorescent material, the first plate 710 may include the yellow fluorescent material, the second plate 720 may include the green fluorescent material, the third plate 730 may include the yellow fluorescent material and the green fluorescent material. The fourth plate 740 may include the yellow fluorescent material and the green fluorescent material, and may have a different content ratio of the yellow fluorescent material and the green fluorescent material from that of the third plate 730. The fourth plate 740 may also include the yellow fluorescent material like the first plate 710.

The embodiment is not limited to the above-mentioned combinations. There may exist numerous combinations as well as the foregoing combinations.

Figure 2:
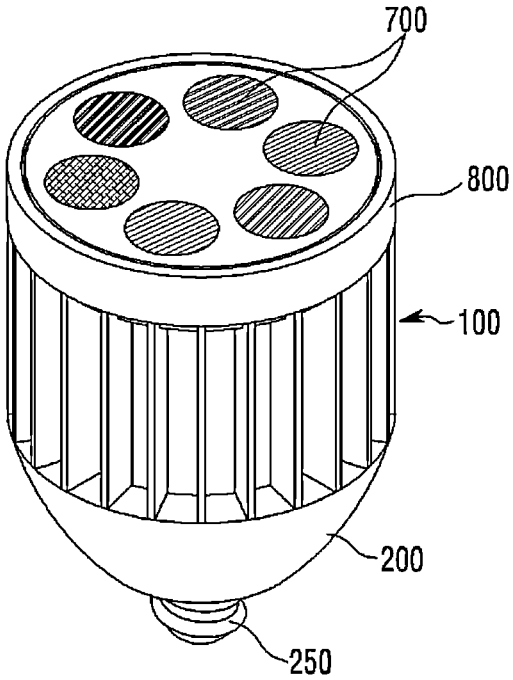
FIG. 2 is a perspective view of the detailed lighting device shown in FIG. 1.
Figure 3:
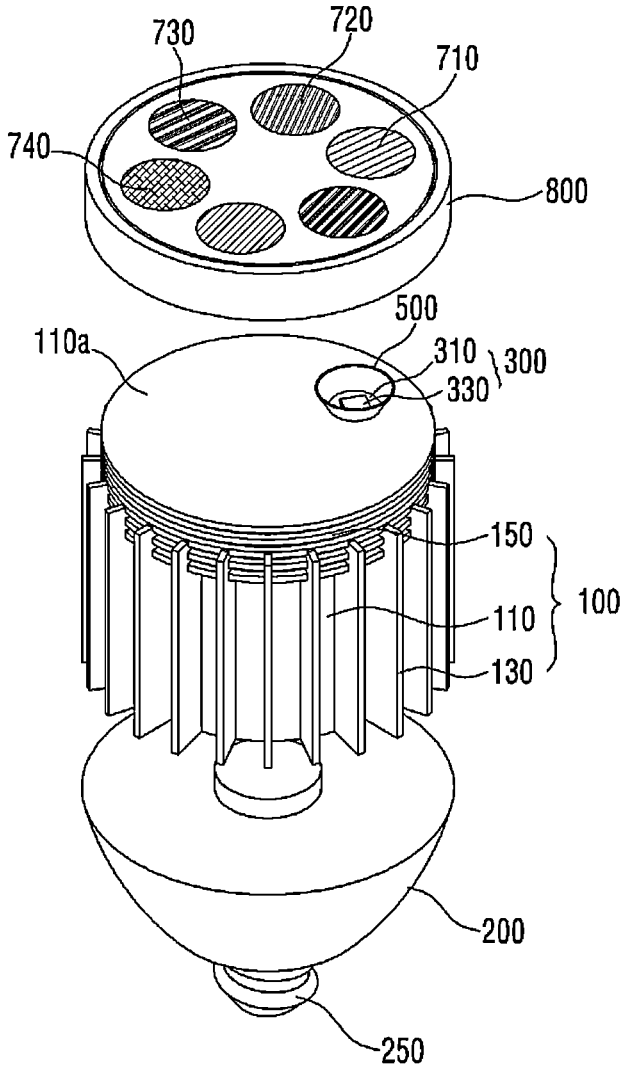
FIG. 3 is an exploded perspective view of the lighting device shown in FIG. 2.

FIG. 2 is a perspective view of the detailed lighting device shown in FIG. 1. FIG. 3 is an exploded perspective view of the lighting device shown in FIG. 2.

Referring to FIGS. 2 and 3, the lighting device according to the embodiment may include the body part 100, a driving unit 200, the light source module 300, the reflector 500, the optical exciter 700 and a cover 800.

The body part 100, the light source module 300, the reflector 500 and the optical exciter 700 which are shown in FIGS. 2 and 3 correspond to the body part 100, the light source module 300, the reflector 500 and the optical exciter 700 which are shown in FIG. 1.

More specifically, the body part 100 shown in FIGS. 2 and 3 may include a body 110, the heat radiating fin 130 and a coupling recess 150.

The body 110 may have a cylindrical shape. The body 110 may include a through-hole through which a wiring passes. The wiring electrically connects the light source module 300 with the driving unit 200. Though not shown in the drawings, the body 110 may also include a receiving recess receiving the driving unit 200.

A plurality of the heat radiating fins 130 may be disposed on a cylindrical surface of the body 110, i.e., the lateral surface of the body 110 and may have a predetermined length in the up and down direction. The heat radiating fin 130 may be connected to the body 110 or may be integrally formed with the body 110.

The coupling recess 150 may be disposed in one side of the body 110. Specifically, the coupling recess 150 may be disposed in the upper portion of the body 110 coupled to the cover 800. As shown in FIG. 3, the coupling recess 150 may be a screw recess. The coupling recess 150 is coupled to the cover 800. The coupling recess 150 allows the cover 800 to move in a rotational manner and is rotationally coupled to the body part 100. The rotational movement of the cover 800 causes the optical exciter 700 to move.

The light source module 300 is disposed on the body part 100. Specifically, the light source module 300 may be disposed on one side 110*a* of the body 110. Here, the one side 110*a* of the body 110 may be flat or predeterminedly curved.

The light source module 300 may be disposed on a first axis. The first axis may be an imaginary axis perpendicular to the one side 110*a* of the body part 100. Here, the first axis may be parallel with the central axis of the one side 110*a*.

The light source module 300 includes the substrate 310 disposed on the one side 110*a* of the body 110 and the light emitting device 330 disposed on the substrate 310. Here, the light source module 300 may further include a molding part (now shown) disposed on the light emitting device 330. The molding part (not shown) may cover the light emitting device 330 and include a fluorescent material.

Though FIGS. 2 and 3 show one light emitting device 330, there is no limit to this. A plurality of the light emitting devices 330 may be disposed on the substrate 310.

The reflector 500 surrounds the light source module 300 and may be disposed on the one side 110*a* of the body 110. The lower portion of the reflector 500 may be disposed on the one side 110*a* of the body 110 or may be disposed on the substrate 310. The upper portion of the reflector 500 may be disposed corresponding to any one of the plural plates 710, 720, 730 and 740 of the optical excitation plate 700.

The reflector 500 may be a reflective surface. This will be described in detail with reference to FIG. 4.

Figure 4:
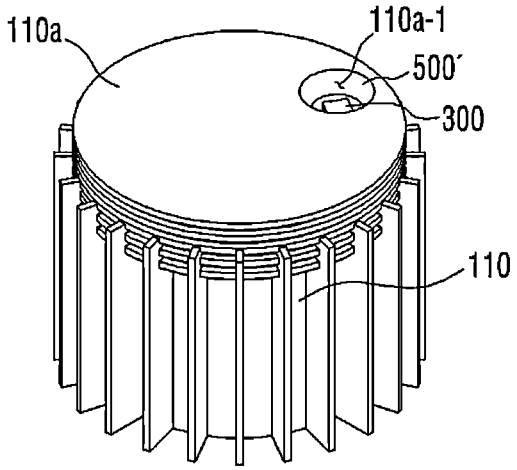
FIG. 4 is a perspective view of a modified example of a body part of the lighting device shown in FIG. 3.

FIG. 4 is a perspective view of a modified example of the body part 100 of the lighting device shown in FIG. 3.

Referring to FIG. 4, the one side 110*a* of the body 110 includes a recess 110*a*-1. The recess 110*a*-1 may be a groove having a predetermined depth formed inwardly from the one side 110*a*.

The recess 110*a*-1 may be defined by its bottom surface and its lateral surface. The light source module 300 is disposed on the bottom surface of the recess 110*a*-1.

A reflective surface 500' deposited or coated with a material capable of reflecting the light emitted from the light source module 300 may be disposed on the lateral surface of the recess 110*a*-1.

Referring back to FIGS. 2 and 3, the optical excitation plate 700 is disposed over the light source module 300. Specifically, the optical excitation plate 700 is disposed in the cover 800. The optical excitation plate 700 may be disposed over the light source module 300 by the coupling of the cover 800 and the body part 100.

The optical excitation plate 700 may include the plural plates 710, 720, 730 and 740. The plural plates 710, 720, 730 and 740 may be disposed in the cover 800.

The plural plates 710, 720, 730 and 740 may be disposed separately from each other and, as shown in FIG. 1, may be also connected with each other.

As described above, the plural plates 710, 720, 730 and 740 include a predetermined fluorescent material. The detailed description thereof will be replaced by the foregoing description.

The plural plates 710, 720, 730 and 740 one-to one correspond to the light emitting devices 330 of the light source module 300 respectively. This can be controlled by the movement of the cover 800. For example, the light source module 300 may correspond to any one of the plural plates 710, 720, 730 and 740 by the rotation of the cover 800.

The cover 800 is coupled to the body part 100. Specifically, the cover 800 includes a coupler (not shown) which can be coupled to the coupling recess 150 of the body part 100. The coupler (not shown) may be coupled to the coupling recess 150 by rotation. The cover 800 is able to cover the one side 100*a* of the body 110 by the coupling of the cover 800 and the body part 100.

The cover 800 may rotate about a second axis. Here, the second axis may be parallel with the first axis on which the light source module 300 is disposed. Also, the second axis may be the central axis of the one side 110*a* of the body part 100.

The optical exciter 700 is disposed in the cover 800. Specifically, the cover 800 may holes in which the plural plates 710, 720, 730 and 740 of the optical exciter 700 are disposed respectively.

The driving unit 200 may be disposed on the other side of the body part 100.

The driving unit 200 may be electrically connected to the light source module 300 by means of a wiring passing through the through-hole of the body part 100.

The driving unit 200 performs a function of supplying external electric power to the light source module 300.

The inside of the driving unit 200 may include a plurality of parts for power control. The parts may include, for example, a DC converter converting AC power supply supplied by an external power supply into DC power supply, a driving chip controlling the driving of the light source module 300 and an electrostatic discharge (ESD) protective device for protecting the light source module 300.

The driving unit 200 is connected to an external power supply through a socket 250 and may receive electric power from the external power supply.

The lighting device shown in FIGS. 1 to 4 is able to satisfy various optical requirements. This may be done by the optical exciter 700 of the lighting device shown in FIGS. 1 to 4. Specifically, the lighting device according to the embodiment is able to emit light having various color temperatures by controlling the optical exciter 700.

Figure 5:
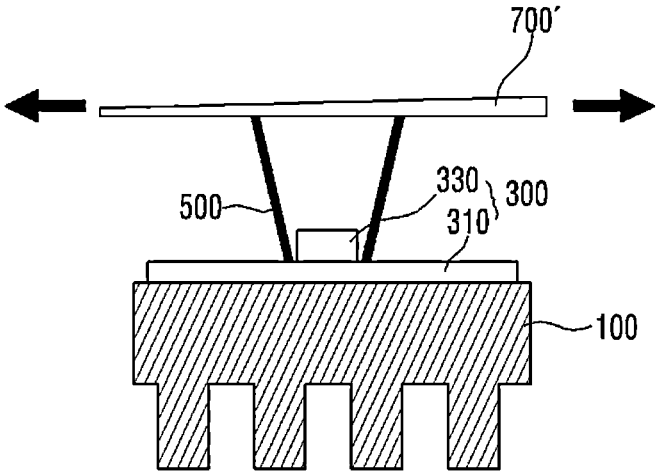
FIG. 5 is a cross sectional view of a lighting device according to another embodiment.

FIG. 5 is a cross sectional view of a lighting device according to another embodiment.

In the description of the lighting device according to the another embodiment shown in FIG. 5, the same reference numerals are assigned to the same parts as those of the lighting device shown in FIG. 1. Description of the same parts will be omitted.

Referring to FIG. 5, the lighting device according to another embodiment may include the body part 100, the light source module 300, the reflector 500 and an optical exciter 700'. The descriptions of the body part 100, the light source module 300, and the reflector 500 will be replaced by the description of FIG. 1.

The optical exciter 700' is different from the optical exciter 700 shown in FIG. 1. Hereafter, this will be described in detail.

The optical exciter 700' may be an optical excitation plate having a plate shape.

The optical excitation plate 700' has a predetermined thickness. The thickness is not uniform. That is, the optical excitation plate 700' becomes thinner or thicker toward one end thereof.

The optical excitation plate 700' includes a fluorescent material. Specifically, the optical excitation plate 700' may include at least one of yellow, green and red fluorescent materials. That is, the optical excitation plate 700' may include only the yellow fluorescent material, may include the yellow fluorescent material and the green fluorescent material or may include the yellow, green and red fluorescent materials.

Since the thickness the optical excitation plate 700' is increased or decreased toward one end thereof, the thicker portion of the optical excitation plate 700' includes more fluorescent material than the thinner portion of the optical excitation plate 700'.

The optical excitation plate 700' may be fixed or may move over the light emitting device 330, like the optical excitation plate 700 shown in FIG. 1.

The lighting device shown in FIG. 5 may be applied to the lighting device shown in FIGS. 2 to 4. This will be described with reference to FIG. 6.

Figure 6:
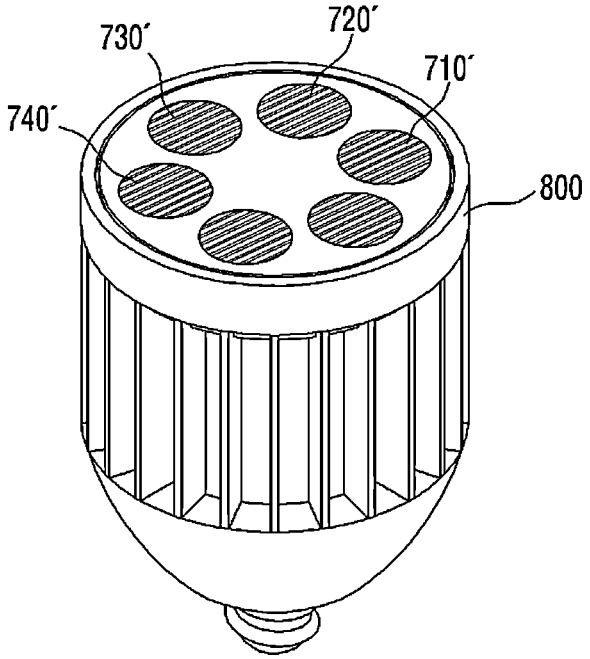
FIG. 6 is a perspective view of the detailed lighting device shown in FIG. 5.

FIG. 6 is a perspective view of the detailed lighting device shown in FIG. 5.

Referring to FIG. 6, the optical excitation plate 700' shown in FIG. 5 may include plural plates 710', 720', 730' and 740' having mutually different thicknesses.

Each of the plural plates 710', 720', 730' and 740' may have a uniform thickness or may have a non-uniform thickness like the optical excitation plate 700' shown in FIG. 5. That is, the thickness of each of the plural plates 710', 720', 730' and 740' may be increased or decreased toward one end thereof.

The plural plates 710', 720', 730' and 740' may be disposed in the cover 800 and may move over the light emitting device 330 by the rotation of the cover 800.

The lighting device shown in FIGS. 5 and 6 is able to satisfy various optical requirements. This may be done by the optical exciter 700' of the lighting device shown in FIGS. 5 and 6. Specifically, the lighting device according to the embodiment is able to emit light having various color temperatures by controlling the optical exciter 700'.

Figure 7:
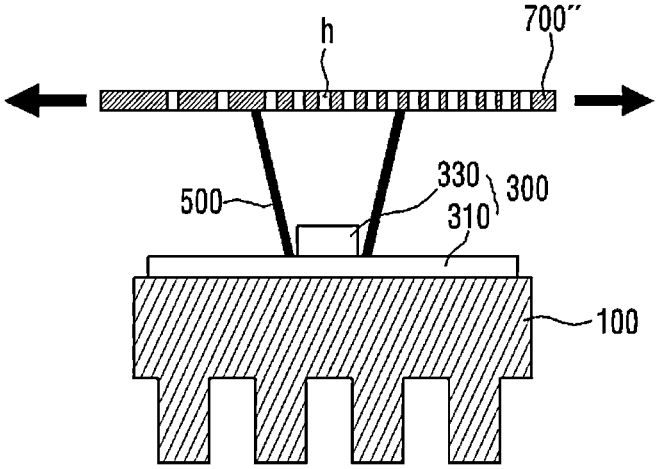
FIG. 7 is a cross sectional view of a lighting device according to further another embodiment.

FIG. 7 is a cross sectional view of a lighting device according to further another embodiment.

In the description of the lighting device according to further another embodiment shown in FIG. 7, the same reference numerals are assigned to the same parts as those of the lighting device shown in FIG. 1. Description of the same parts will be omitted.

Referring to FIG. 7, the lighting device according to further another embodiment may include the body part 100, the light source module 300, the reflector 500 and an optical exciter 700". The descriptions of the body part 100, the light source module 300, and the reflector 500 will be replaced by the description of FIG. 1.

The optical exciter 700" is different from the optical exciter 700 shown in FIG. 1. Hereafter, this will be described in detail.

The optical exciter 700" may be an optical excitation plate having a plate shape.

The optical excitation plate 700" has a predetermined thickness. Here, the thickness may be uniform as shown in FIG. 7 or may not be uniform as shown in FIG. 5. When the thickness is not uniform, the optical excitation plate 700" becomes thinner or thicker toward one end thereof.

The optical excitation plate 700" includes a fluorescent material. Specifically, the optical excitation plate 700" may include at least one of yellow, green and red fluorescent materials. That is, the optical excitation plate 700" may include only the yellow fluorescent material, may include the yellow fluorescent material and the green fluorescent material or may include the yellow, green and red fluorescent materials.

The optical excitation plate 700" includes a hole "h". The hole "h" passes through the optical excitation plate 700". The hole "h" has a diameter equal to or less than 1 mm. Here, when the diameter of the hole "h" is larger than 1 mm, excitation ratio may be reduced.

The optical excitation plate 700" includes a plurality of the holes "h". The plurality of the holes "h" may be uniformly or non-uniformly disposed on the optical excitation plate 700". Specifically, the interval between the plurality of the holes "h" may be more increased or decreased the closer it is to one end from the other end of the optical excitation plate 700". The number of the holes "h" may be greater or smaller the closer it is to one end from the other end of the optical excitation plate 700".

The optical excitation plate 700" may be fixed or may move over the light emitting device 330, like the optical excitation plate 700 shown in FIG. 1.

The lighting device shown in FIG. 7 may be applied to the lighting device shown in FIGS. 2 to 4. This will be described with reference to FIG. 8.

Figure 8:
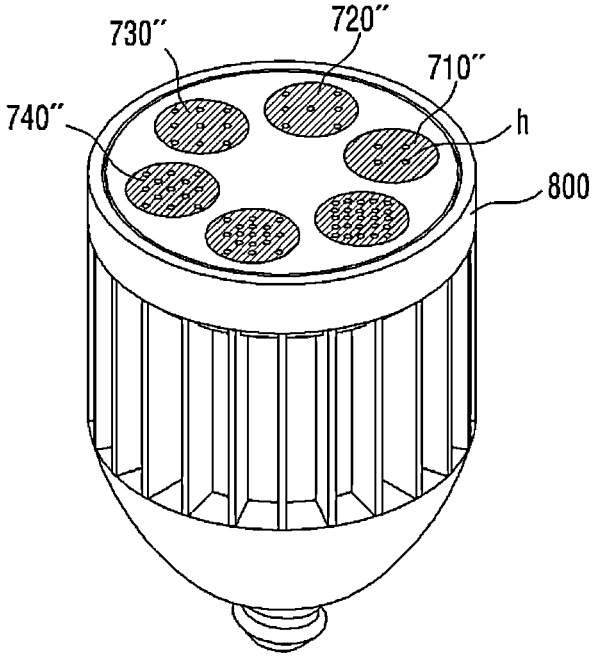
FIG. 8 is a perspective view of the detailed lighting device shown in FIG. 7.

FIG. 8 is a perspective view of the detailed lighting device shown in FIG. 7.

When the lighting device shown in FIG. 8 is applied to the lighting device shown in FIGS. 2 to 4, the optical exciter 700" may include plural plates 710", 720", 730" and 740".

The plural plates 710", 720", 730" and 740" include a plurality of holes "h" respectively.

The numbers of the holes "h" included in the plural plates 710", 720", 730" and 740" are different from each other. For example, the number of the holes "h" of the first plate 710" may be less than the number of the holes "h" of the second plate 720", the number of the holes "h" of the second plate 720" may be less than the number of the holes "h" of the third plate 730", and the number of the holes "h" of the third plate 730" may be less than the number of the holes "h" of the fourth plate 740".

In each of the plural plates 710", 720", 730" and 740", the plurality of the holes "h" may be uniformly or non-uniformly disposed.

The plural plates 710", 720", 730" and 740" may be disposed in the cover 800 and may move over the light emitting device 330 by the rotation of the cover 800.

The lighting device shown in FIGS. 7 and 8 is able to satisfy various optical requirements. This may be done by the optical exciter 700" of the lighting device shown in FIGS. 7 and 8. Specifically, the lighting device according to the embodiment is able to emit light having various color temperatures by controlling the optical exciter 700".

Figure 9:
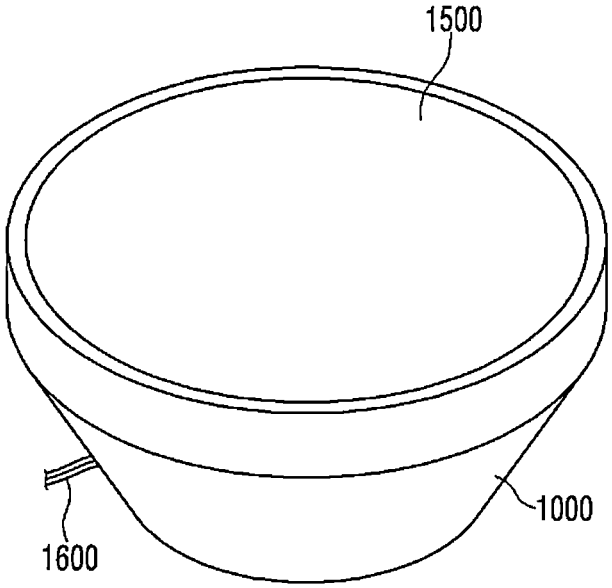
FIG. 9 is a cross sectional view of a lighting device according to yet another embodiment.
Figure 10:
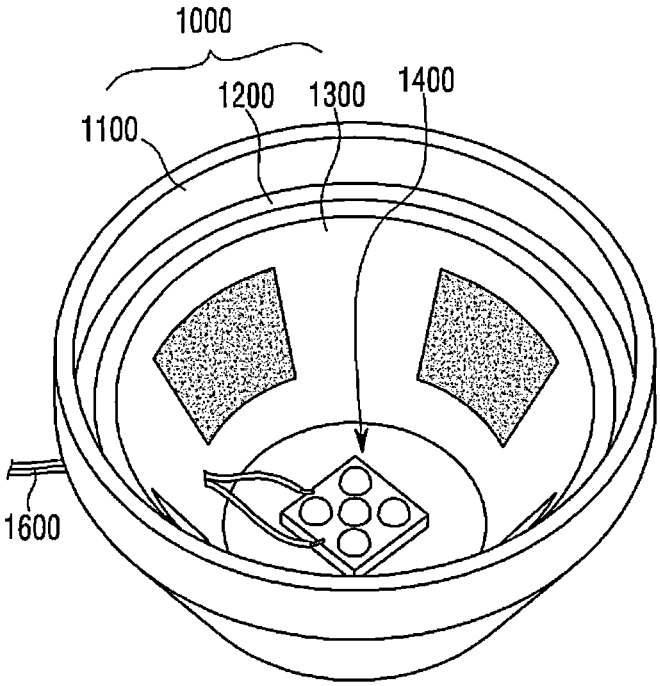
FIG. 10 is a perspective view showing that the lighting device shown in FIG. 9 does not include a diffusion plate.
Figure 11:
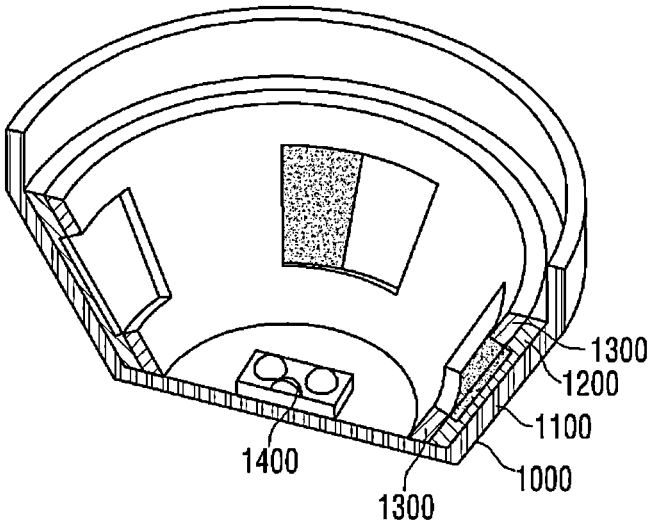
FIG. 11 is a cross sectional view of the lighting device shown in FIG. 10.

FIG. 9 is a cross sectional view of a lighting device according to yet another embodiment. FIG. 10 is a perspective view showing that the lighting device shown in FIG. 9 does not include a diffusion plate 1500. FIG. 11 is a cross sectional view of the lighting device shown in FIG. 100

Referring to FIGS. 9 to 11, the lighting device according to yet another embodiment may include a body part 1000, a light source module 1400 disposed on the inner bottom surface of the body part 1000, a diffusion plate 1500 disposed apart from the light source module 1400 at a predetermined interval, and a wire 1600 transmitting external electric power to the light source module 1400.

The body part 1000 has a predetermined volume. The body part 1000 may form a main appearance of the lighting device according to yet another embodiment. The body part 1000 may include, as shown in FIGS. 10 and 11, an outer layer 1100, a fluorescent layer 1200 and a reflective layer 1300. Each of them will be described below.

The body part 1000 may be a heat sink which receives heat from the light source module 1400 and radiates the heat. Though not shown in the drawing, a heat radiating plate (not shown) may be disposed between the body part 1000 and the light source module 1400. The heat radiating plate (not shown) may be a thermal conduction silicon pad or a thermal conductive tape which has high thermal conductivity. The heat radiating plate (not shown) is able to effectively transfer the heat generated from the light source module 1400 to the body part 1000.

The light source module 1400 may be disposed on the inner bottom surface of the body part 1000. The light source module 1400 may include a substrate and a light emitting device disposed on the substrate. Since the light source module 1400 is the same as the light source module 300 shown in FIG. 1, detailed descriptions thereof will be omitted.

The diffusion plate 1500 may be disposed apart from the light source module 1400 at a predetermined interval. Specifically, the diffusion plate 1500 may be disposed in the inner upper portion of the body part 1000.

As shown in FIG. 9, the diffusion plate 1500 may be disposed in the inner upper portion of the body part 1000 and eventually may be disposed in the opening of the body part 1000. Also, one side of the diffusion plate 1500 faces the light source module 1400 disposed on the inner bottom surface of the body part 1000, and the other side of the diffusion plate 1500 is disposed to be exposed outward through the opening.

When the diffusion plate 1500 may be disposed apart from the light source module 1400 at a predetermined interval, a mixing space may be formed by the diffusion plate 1500 and the body part 1000. The lights which are emitted from the light source module 1400 or the lights which are emitted from the light source module 1400 and reflected by the inner surface of the body part 1000 may be mixed in the mixing space. The mixing space may be filled with various materials according to purpose and use. For example, air may be filled in the mixing space.

The diffusion plate 1500 may be formed of at least one of a resin material and silicon material. The diffusion plate 1500 may be formed of silicone resin among them.

The diffusion plate 1500 is able to scatter and diffuse the incident light. The diffusion plate 1500 may include a diffusing agent. The diffusing agent may include any one selected from the group consisting of $SiO_2$, $TiO_2$, ZnO, $BaSO_4$, $CaSO_4$, $MgCO_3$, $Al(OH)_3$, synthetic silica, glass beads and diamond. However, the material of the diffusing agent is not limited to this.

The wire 1600 is electrically connected to the light source module 1400, so that the wire 1600 is able to transmit external electric power to the light source module 1400. The body part 1000 may include a hole through which the wire 1600 passes.

Hereafter, the body part 1000 will be described in detail with reference to the accompanying drawings.

Figure 12:
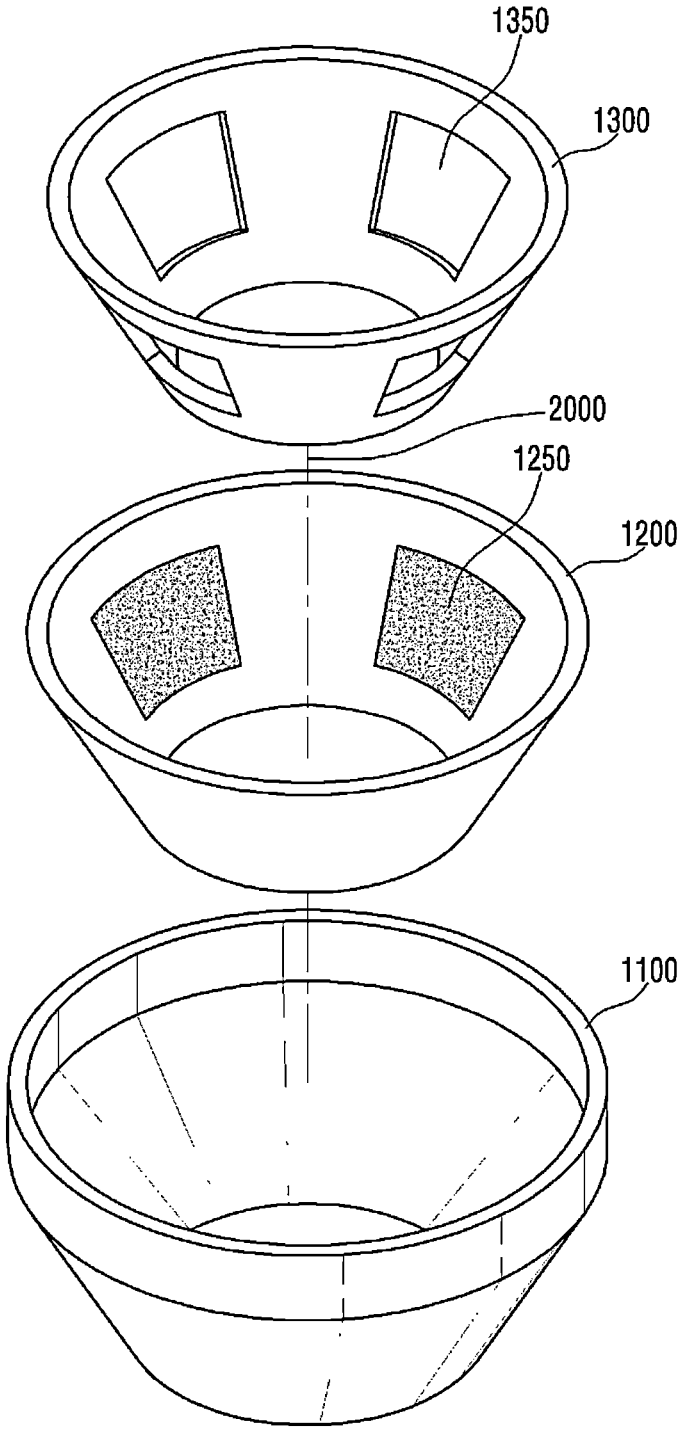
FIG. 12 is an exploded perspective view of a body part shown in FIG. 10.

FIG. 11 is a cross sectional view of the lighting device shown in FIG. 10. FIG. 12 is an exploded perspective view of the body part 1000 shown in FIG. 10.

Referring to FIGS. 11 and 12, the body part 1000 may include the outer layer 1100, the fluorescent layer 1200 disposed between the outer layer 1100 and the inside of the body part 1000, and the reflective layer 1300 disposed between the fluorescent layer 1200 and the inside of the body part 1000. In other words, the body part 1000 may include the outer layer 1100, the fluorescent layer 1200 disposed inside the outer layer 1100, and the reflective layer 1300 disposed inside the fluorescent layer 1200.

The outer layer 1100 may be positioned at the outermost position of the body part 1000. Referring to FIGS. 11 and 12, the outer layer 1100 may include a top opening. The outer layer 1100 may form a main appearance of the lighting device according to yet another embodiment and to protect the inside of the lighting device according to yet another embodiment. Also, the outer layer 1100 receives the heat radiated from the light source module 1400 and functions to outwardly radiate the heat.

The outer layer 1100 may be formed of a metallic material or a resin material which has excellent heat radiation efficiency. However, there is no limit to the material of the outer layer 1100. For example, the outer layer 1100 may be formed of Fe, Al, Ni, Cu, Ag, Sn, Mg and the like or an alloy including at least one material among them. Carbon steel and stainless steel can be also used as the material of the outer layer 1100. Anti-corrosion coating or insulating coating may be performed on the surface of the outer layer 1100 within a range which does not affect thermal conductivity.

The reflective layer 1300 may be positioned at the innermost position of the body part 1000. Referring to FIGS. 11 and 12, the reflective layer 1300 may include a top opening and a bottom opening.

The reflective layer 1300 may reflect the incident light emitted from the light source module 1400. The reflective layer 1300 surrounds the light source module 1400 and may easily reflect the light emitted the light source module 1400 to the diffusion plate 1500. A light reflective material may be coated or deposited on the inner surface of the reflective layer 1300 so as to easily reflect the light emitted the light source module 1400. Here, the reflectance of the surface of the reflective surface 1300 can be designed to be equal to or greater than 70%.

As shown in FIGS. 11 and 12, the reflective layer 1300 may form an obtuse angle with the substrate of the light source module 1400. The reflective layer 1300 may be also substantially perpendicular to the substrate of the light source module 1400.

Figure 13:
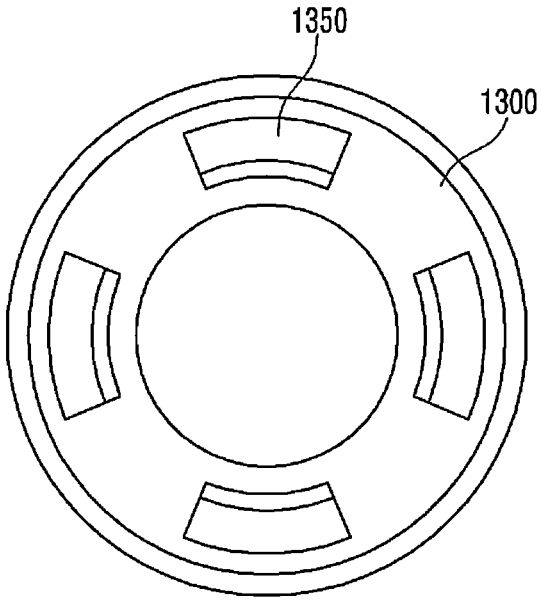
FIG. 13 is a plan view of a reflective layer shown in FIG. 12.

FIG. 13 is a plan view of the reflective layer 1300 shown in FIG. 12. As shown in FIGS. 12 and 13, a punched hole 1350 which passes through the reflective layer 1300 may be formed in at least a portion of the reflective layer 1300.

Figure 14:
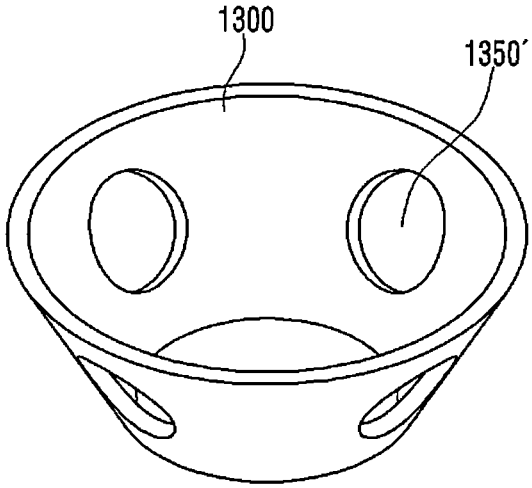
FIG. 14 is a perspective view of a reflective layer according to still another embodiment.
Figure 15:
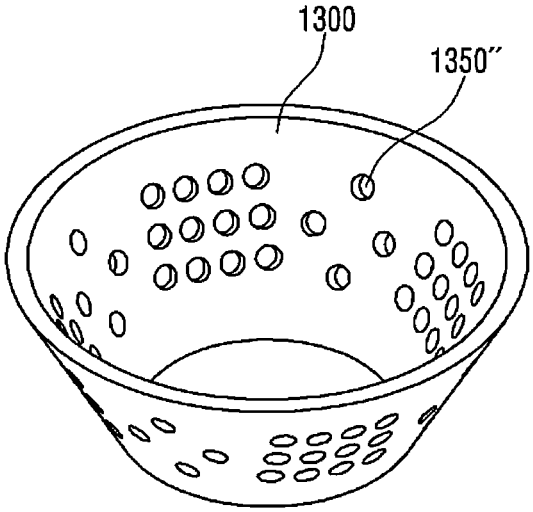
FIG. 15 is a perspective view of a reflective layer according to still another embodiment.

The punched hole 1350 may have, as shown in FIGS. 12 and 13, a quadrangular shape. This is just an example. The shape of the punched hole 1350 may be variously changed according to circumstances and is not limited to the quadrangular shape. For example, as shown in FIG. 14, the punched hole 1350' may have a circular shape. Also, for example, FIG. 15 shows there are a plurality of small circular punched holes 1350" and the number of the punched holes 1350" per unit area may be changed depending on the portions of the reflective layer 1300. Specifically, the number of first punched holes formed in a portion (a first portion)

of the reflective layer 1300 among the plurality of the punched holes may be different from the number of second punched holes formed in another portion (a second portion) of the reflective layer 1300.

Referring back to FIGS. 11 and 12, the four punched holes 1350 may be formed separately from each other. This is only an example. The number of the punched holes 1350 can be variously changed according to circumstances.

As shown in FIG. 12, the maximum diameter of the punched hole 1350 may be almost the same as a distance between the two adjacent punched holes 1350. This is an only example. A ratio of the area of the punched hole 1350 to the entire area of the inner surface of the reflective layer 1300 can be changed according to circumstances.

As shown in FIG. 12, the punched holes 1350 may be symmetrically formed. This is just an example. The punched holes 1350 may be asymmetrically formed according to circumstances. However, when the punched holes 1350 are symmetrically formed as shown in FIG. 12, the light emitted from the lighting device according to yet another embodiment can be seen uniformly.

As shown in FIGS. 11 and 12, when the punched hole 1350 is formed in a portion of the reflective layer 1300, a portion of the fluorescent layer 1200 disposed on the outer surface of the reflective layer 1300 may be exposed to the light which is emitted from the light source module 1400 and passes through the punched hole 1350.

The fluorescent layer 1200 may be disposed inside the outer layer 1100 and may be positioned at the outermost position of the reflective layer 1300. Referring to FIGS. 11 and 12, the fluorescent layer 1200 may include a top opening and a bottom opening.

As shown in FIGS. 11 and 12, the fluorescent layer 1200 may form an obtuse angle with the substrate of the light source module 1400. The fluorescent layer 1200 may be also substantially perpendicular to the substrate of the light source module 1400.

Figure 16:
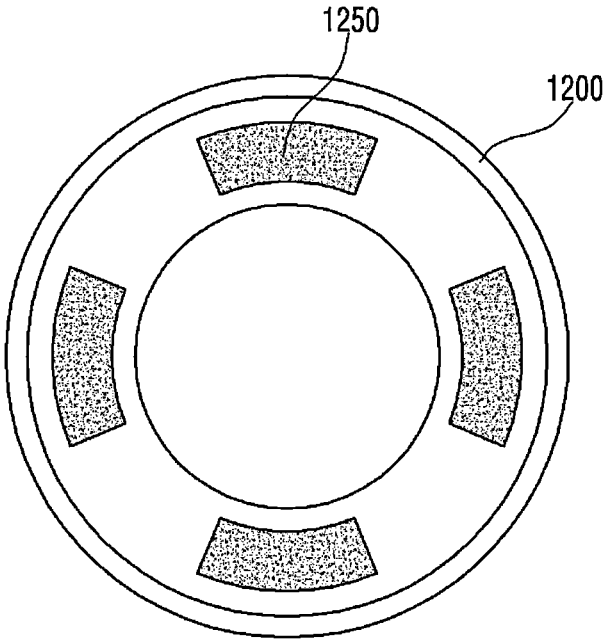
FIG. 16 is a plan view of a fluorescent layer shown in FIG. 12.

FIG. 16 is a plan view of the fluorescent layer 1200 shown in FIG. 12. As shown in FIGS. 12 and 16, a fluorescent surface 1250 may be disposed on a portion of the inner surface of the fluorescent layer 1200.

The fluorescent surface 1250 may be formed by a coating method or may be attached in the form of a film.

The fluorescent surface 1250 may include at least one fluorescent material. The fluorescent material is able to excite incident light and to emit light with a particular wavelength.

Specifically, the fluorescent surface 1250 may include at least one of a yellow fluorescent material, a green fluorescent material and a red fluorescent material. However, there is no limit to the kind of the fluorescent material. The kind and amount of the fluorescent material included in the fluorescent surface 1250 can be changed according to circumstances. The yellow fluorescent material emits light having a dominant wavelength of from 540 nm to 585 nm in response to the blue light (430 nm to 480 nm). The green fluorescent material emits light having a dominant wavelength of from 510 nm to 535 nm in response to the blue light (430 nm to 480 nm). The red fluorescent material emits light having a dominant wavelength of from 600 nm to 650 nm in response to the blue light (430 nm to 480 nm). The yellow fluorescent material may be a silicate fluorescent material or a YAG fluorescent material. The green fluorescent material may be a silicate fluorescent material, nitride fluorescent material or a sulfide fluorescent material. The red fluorescent material may be a nitride fluorescent material or a sulfide fluorescent material.

In the inner surface of the fluorescent layer 1200, the remaining portion other than portions where the fluorescent surfaces 1250 have been formed may be formed of a light reflective material. Therefore, when the light emitted from the light source module 1400 is incident on the remaining portion, the light can be reflected. The reflectance of the remaining portion may be equal to or greater than 70%.

As shown in FIGS. 12 and 16, the fluorescent surface 1250 may have a quadrangular shape. This is only an example. The shape of the fluorescent surface 1250 may be variously changed according to circumstances and is not limited to the quadrangular shape.

As shown in FIGS. 12 and 16, the four fluorescent surfaces 1250 may be also formed separately from each other. This is just an example. The number of the fluorescent surfaces 1250 can be variously changed according to circumstances.

As shown in FIG. 12, the maximum diameter of the fluorescent surface 1250 may be similar to a distance between the two adjacent fluorescent surfaces 1250. This is an only example. A ratio of the area of the fluorescent surface 1250 to the entire area of the inner surface of the fluorescent layer 1200 can be changed according to circumstances.

As shown in FIG. 12, the fluorescent surface 1250 may be symmetrically formed. This is just an example. The fluorescent surface 1250 may be asymmetrically formed according to circumstances. However, when the fluorescent surface 1250 are symmetrically formed as shown in FIG. 12, the light emitted from the lighting device according to yet another embodiment can be seen uniformly.

The fluorescent surface 1250 may be disposed at a position corresponding to the punched hole 1350 of the reflective layer 1300. The fluorescent surface 1250 and the punched hole 1350 may have the same size and shape. This is just an example. The locations and areas of the fluorescent surface 1250 and the punched hole 1350 may be changed according to circumstances.

The fluorescent surface 1250 may be formed on a portion of the inner surface of the fluorescent layer 1200. The fluorescent surface 1250 may be formed such that the content ratio or mixing ratio of the fluorescent materials included per unit area of the fluorescent surface 1250 is changed depending on the portions of the fluorescent surface 1250. That is, the content ratio or mixing ratio of the fluorescent materials included the fluorescent surface 1250 may be changed toward one side from the other side of the fluorescent surface 1250.

The reflective layer 1300 or the fluorescent layer 1200 may rotate about a predetermined point or a predetermined axis. For example, the reflective layer 1300 or the fluorescent layer 1200 may rotate about a straight line connecting the central point of the body part 1000 with the central point of the light source module 1400. In other words, the reflective layer 1300 or the fluorescent layer 1200 may rotate about a central axis 2000 shown in FIG. 12.

Both of the reflective layer 1300 and the fluorescent layer 1200 may be configured to be rotatable. Otherwise, one of the reflective layer 1300 and the fluorescent layer 1200 may be configured to be fixed and the other may be configured to be rotatable. Otherwise, both of the reflective layer 1300 and the fluorescent layer 1200 may be configured to be fixed without rotation.

It is assumed that at least one of the reflective layer 1300 and the fluorescent layer 1200 is configured to be rotatable. For example, it is assumed that the fluorescent layer 1200 is fixed and the reflective layer 1300 is rotatable. A portion of the inner surface of the fluorescent layer 1200, which is exposed to the light which is emitted from the light source module 1400 and passes through the punched hole 1350, may be changed depending on the rotation degree of the reflective layer 1300. Namely, depending on the rotation degree of the reflective layer 1300, a portion where the fluorescent surface 1250 is formed in the inner surface of the fluorescent layer 1200 may be exposed to the light which is emitted from the light source module 1400 and passes through the punched hole 1350, and the remaining portion where the fluorescent surface 1250 is not formed may be exposed to the light emitted from the light source module 1400 and passes through the punched hole 1350. Also, a part of the portion where the fluorescent surface 1250 is formed and a part of the remaining portion where the fluorescent surface 1250 is not formed may be exposed to the light which is emitted from the light source module 1400 and passes through the punched hole 1350.

Figure 17:
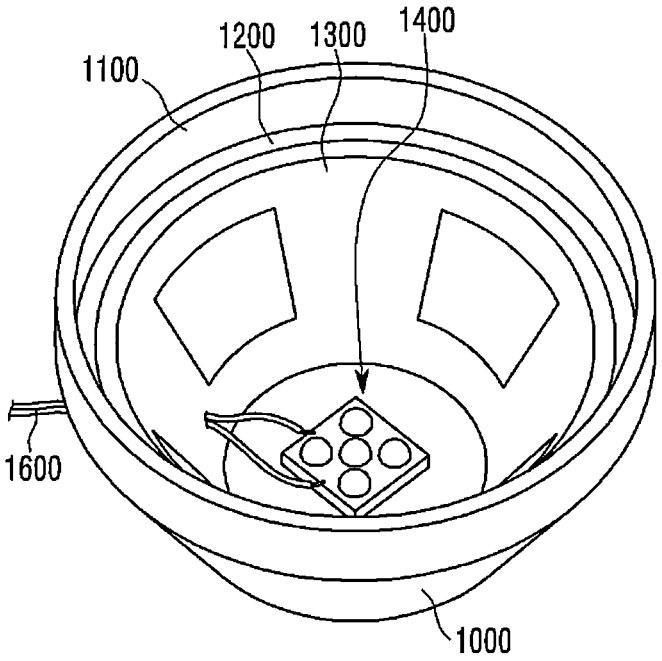
FIG. 17 is a perspective view showing that the reflective layer or the fluorescent layer is rotated in such a manner that a fluorescent surface is not exposed.

FIG. 10 shows that the reflective layer 1300 or the fluorescent layer 1200 rotates in such a manner that the fluorescent surface 1250 is exposed to the light emitted from the light source module 1400. FIG. 17 shows that the reflective layer 1300 or the fluorescent layer 1200 rotates in such a manner that the fluorescent surface 1250 is not exposed to the light emitted from the light source module 1400. FIG. 11 shows that the reflective layer 1300 or the fluorescent layer 1200 rotates in such a manner that a part of the portion where the fluorescent surface 1250 is formed and a part of the remaining portion where the fluorescent surface 1250 is not formed are exposed to the light emitted from the light source module 1400.

Through this embodiment, the reflective layer 1300 or the fluorescent layer 1200 is configured to be rotatable, thereby controlling the area of the fluorescent surface 1250, which is exposed to the light through the punched hole 1350 in accordance with the rotation degree of the reflective layer 1300 or the fluorescent layer 1200. A ratio of light which is excited and emitted by the fluorescent material included in the fluorescent surface 1250 may be increased with the increase of the exposed area of the fluorescent surface 1250. Contrarily, the ratio of the exposed and emitted light may be decreased with the reduction of the exposed area of the fluorescent surface 1250.

When the content ratio or mixing ratio of the fluorescent materials included per unit area of the fluorescent surface 1250 is changed depending on the portions of the fluorescent surface 1250 formed in the fluorescent layer 1200, the content ratio or mixing ratio of the fluorescent materials included the fluorescent surface 1250 exposed through the punched hole 1350 in the inner surface of the fluorescent layer 1200 can be controlled depending on the rotation degree of the fluorescent layer 1200 or the reflective layer 1300.

Therefore, in the lighting device, the color temperature of the emitted light can be easily controlled by the rotation of the reflective layer 1300 or the fluorescent layer 1200. Also, the color rendering index (CRI) of the emitted light can be controlled by the rotation of the reflective layer 1300 or the fluorescent layer 1200.

Hereafter, color temperature variation and light speed variation of the light emitted from the lighting device in accordance with a degree to which the fluorescent surface 1250 is exposed will be described in detail with reference to the accompanying drawings.

Figure 18:
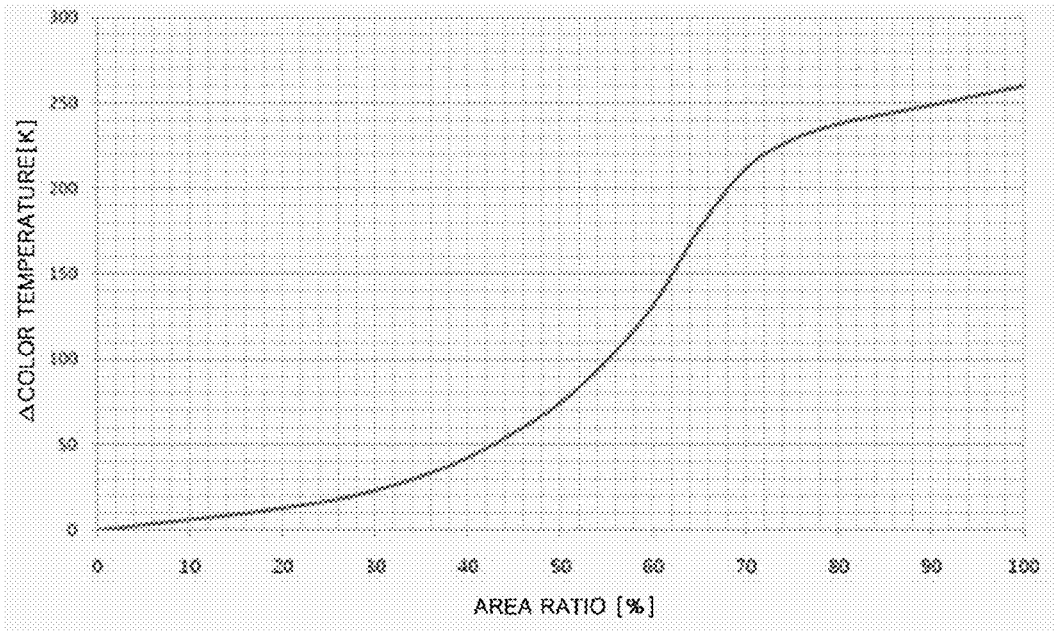
FIG. 18 is a two-dimensional graph showing an experimental result of color temperature variation in accordance with a ratio of the area of the exposed fluorescent surface to the entire area of the inner surface of the reflective layer.
Figure 19:
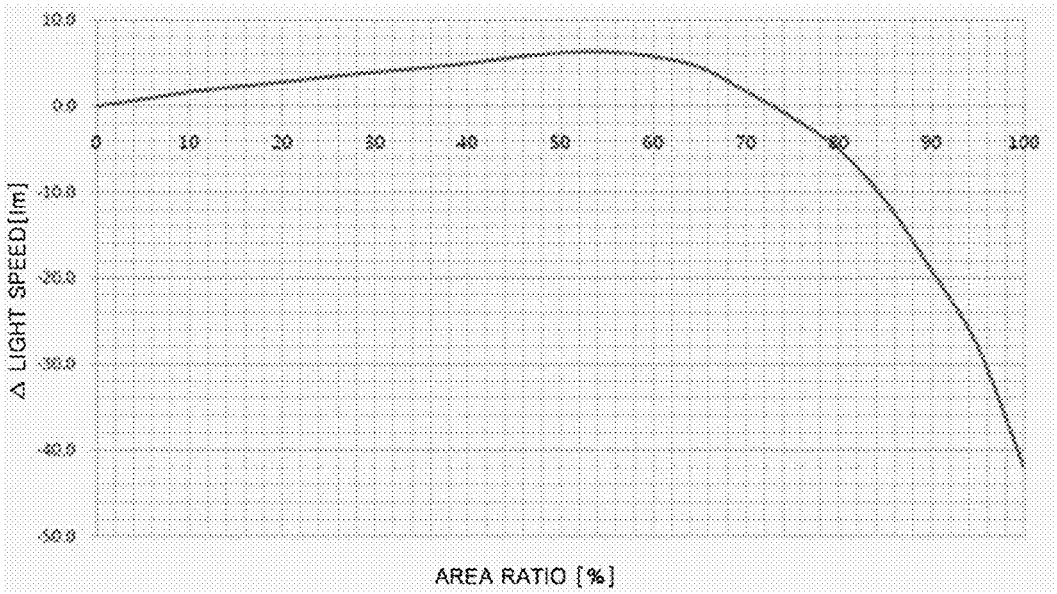
FIG. 19 is a two-dimensional graph showing an experimental result of light speed variation in accordance with a ratio of the area of the exposed fluorescent surface to the entire area of the inner surface of the reflective layer.

FIG. 18 is a two-dimensional graph showing an experimental result of color temperature variation in accordance with a ratio of the area of the exposed fluorescent surface to the entire area of the inner surface of the reflective layer. FIG. 19 is a two-dimensional graph showing an experimental result of light speed variation in accordance with a ratio of the area of the exposed fluorescent surface to the entire area of the inner surface of the reflective layer.

In the experiment, 5450 PKG is used as a light source. The 5450 PKG includes a blue LED chip having a wavelength of 450 nm and a silicate green fluorescent material having a wavelength of 550 nm. The color temperature and CRI of light emitted from the 5450 PKG are about 5000 K and about 70 respectively.

In the experiment, the fluorescent surface 1250 is designed to include the green fluorescent material and the red fluorescent material. It is also designed that a ratio (hereafter, referred to as area ratio) of the area of the exposed fluorescent surface 1250 to the entire area of the inner surface of the reflective layer 1300 is changed within a range between 0% and 100% by giving variety to the area of the fluorescent surface 1250 formed in the fluorescent layer 1200, the area of the punched hole 1350 formed in the reflective layer 1300, and the rotation degree of the reflective layer 1300 or the fluorescent layer 1200.

Referring to FIG. 18, the horizontal axis represents an area ratio and the vertical axis represents the amount of color temperature variation on the basis of a point of time when the area ratio is 0%. The more the area ratio is increased, the more the amount of color temperature variation is increased. When the area ratio is 100%, the color temperature is reduced by as much as about 260 K and moves to warm white. Through the control of the mixing ratio of the fluorescent materials included in the fluorescent surface 1250, the maximum color temperature variation of about 1000 K can occur.

According to the measurement result of the CRI, the CRI increases from 70 to about 85. Through the control of the mixing ratio of the fluorescent materials included in the fluorescent surface 1250, the CRI can be increased maximally greater than 90.

Referring to FIG. 19, the horizontal axis represents an area ratio and the vertical axis represents the amount of light speed variation on the basis of a point of time when the area ratio is 0%. The more the area ratio is increased, the more the light speed is increased. Thus, the light speed is the maximum within an area ratio range from 50% to 60%. In the area ratio larger than 60%, the light speed is decreased with the increase of the area ratio. In other words, the area ratio is too large, a reflectance within the lighting device is reduced, so that the speed of light emitted from the lighting device may be decreased.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light emitting device;

an optical exciter which is disposed over the light emitting device and emits light excited by the light emitted from the light emitting device;

a body part which includes the light emitting device disposed therein, radiates heat from the light emitting device and includes a coupling recess; and a cover which includes the optical exciter disposed therein, includes a coupler coupled to the coupling recess of the body part and rotates along the coupling recess of the body part, wherein the optical exciter moves over the light emitting device, wherein a color temperature of the light emitted from the optical exciter varies according to the movement of the optical exciter, wherein the optical exciter comprises a plurality of plates, wherein the plurality of the plates are disposed over the light emitting device in accordance with the movement of the optical exciter, wherein the plurality of the plates comprise at least one of a yellow fluorescent material, a green fluorescent material and a red fluorescent material, and wherein content ratios of the yellow fluorescent material, the green fluorescent material and the red fluorescent material which are included in the plurality of the plates respectively are different from each other.

2. The lighting device of claim 1, wherein the plates are disposed to be connected with each other or disposed separately from each other.

3. The lighting device of claim 1, further comprising a reflector which surrounds the light emitting device and is disposed between the body part and the optical exciter.

4. The lighting device of claim 1, wherein the body part comprises a recess in which the light emitting device is disposed, and wherein a lateral surface of the recess is a reflective surface.

5. The lighting device of claim 1, wherein each of the plurality of the plates comprises a plurality of holes, and wherein the number of the holes comprised in any one of the plurality of the plates is different from the numbers of the holes comprised in the others.

6. A lighting device comprising:

a light emitting device;

an optical exciter which is disposed over the light emitting device and emits light excited by the light emitted from the light emitting device;

a body part which includes the light emitting device disposed therein, radiates heat from the light emitting device and includes a coupling recess; and a cover which includes the optical exciter disposed therein, includes a coupler coupled to the coupling recess of the body part and rotates along the coupling recess of the body part, wherein the optical exciter moves over the light emitting device, wherein a color temperature of the light emitted from the optical exciter varies according to the movement of the optical exciter, and wherein the optical exciter comprises a plurality of optical excitation plates, and wherein thicknesses of the plurality of the optical excitation plates are different from each other.

7. The lighting device of claim 6, wherein the optical excitation plates includes at least one of a yellow fluorescent material, a green fluorescent material and a red fluorescent material.

8. The lighting device of claim 6, wherein the optical excitation plates are disposed separately from each other.

9. The lighting device of claim 6, further comprising a reflector which surrounds the light emitting device and is disposed between the body part and the optical exciter.

10. The lighting device of claim 6, wherein the body part comprises a recess in which the light emitting device is disposed, and wherein a lateral surface of the recess is a reflective surface.

11. The lighting device of claim 6, wherein each of the plurality of the optical excitation plates comprises a plurality of holes, and wherein the number of the holes comprised in any one of the plurality of the optical excitation plates is different from the numbers of the holes comprised in the others.

12. A lighting device comprising:

a light emitting device; and an optical exciter which is disposed over the light emitting device and emits light excited by the light emitted from the light emitting device, wherein the optical exciter moves over the light emitting device, wherein a color temperature of the light emitted from the optical exciter varies according to the movement of the optical exciter, wherein the optical exciter is one plate including a plurality of holes, and wherein an interval between the plurality of the holes is more increased or decreased the closer it is to one end from the other end of the plate.

13. The lighting device of claim 12, wherein the optical exciter includes at least one of a yellow fluorescent material, a green fluorescent material and a red fluorescent material.

14. The lighting device of claim 12, wherein a diameter of the hole is equal to or less than 1 mm.

15. The lighting device of claim 12, wherein the plate becomes thinner or thicker the closer it is to one side from the other side thereof.

16. The lighting device of claim 12, comprising:

a body part which includes the light emitting device disposed therein, radiates heat from the light emitting device and includes a coupling recess; and a cover which includes the optical exciter disposed therein, includes a coupler coupled to the coupling recess of the body part and rotates along the coupling recess of the body part.

17. The lighting device of claim 16, further comprising a reflector which surrounds the light emitting device and is disposed between the body part and the optical exciter.

18. The lighting device of claim 16, wherein the body part comprises a recess in which the light emitting device is disposed, and wherein a lateral surface of the recess is a reflective surface.

* * * * *